United States Patent [19]

Ikeda et al.

[11] Patent Number: 4,592,653

[45] Date of Patent: Jun. 3, 1986

[54] DRY PROCESS DEVELOPING APPARATUS

[75] Inventors: Takashi Ikeda; Noboru Sawayama, both of Yokohama; Hiroyuki Akamatsu, Sagamihara, all of Japan

[73] Assignee: Ricoh Company, Ltd., Tokyo, Japan

[21] Appl. No.: 472,525

[22] Filed: Mar. 7, 1983

[30] Foreign Application Priority Data

Mar. 12, 1982 [JP] Japan ..... 57-39140
Mar. 24, 1982 [JP] Japan ..... 57-46525

[51] Int. Cl.[4] ..... G03G 15/08
[52] U.S. Cl. ..... 355/3 DD; 355/14 D
[58] Field of Search ..... 355/3 R, 3 DD, 14 D; 222/DIG. 1

[56] References Cited

U.S. PATENT DOCUMENTS 3,863,603 2/1975 Buckley et al. ..... 355/3 DD X
3,872,826 3/1975 Hanson ..... 355/3 DD X
3,900,002 8/1975 Stange ..... 355/3 DD X
4,324,483 4/1982 Tagawa et al. ..... 355/3 DD
4,351,604 9/1982 Karasawa et al. ..... 355/3 DD X
4,392,735 7/1983 Oka ..... 355/3 DD

*Primary Examiner*—Fred L. Braun
*Attorney, Agent, or Firm*—David G. Alexander

[57] ABSTRACT

In a dry process developing apparatus, a seal member closes a gap between a photoconductive element and the upper end of a housing which has a developing roller, a toner supply roller and the like thereinside. A blade for regulating the thickness of a toner layer on the developing roller is spaced at its base end portion from the wall of the housing to set up a toner recirculation path. An oscillator plate extends generally downwardly to neighbor the toner supply roller at the free end thereof. The free end of the vibrator is caused into oscillation by a drive unit. The oscillator and drive unit cooperate to guide a toner dropped by a toner replenish device, which replenishes the toner to the housing, toward the toner supply roller.

21 Claims, 7 Drawing Figures

DRY PROCESS DEVELOPING APPARATUS

BACKGROUND OF THE INVENTION

The present invention relates to a dry process developing apparatus for use with an apparatus for electrophotography.

An electrophotographic apparatus generally includes a developing apparatus for processing into a toner image a latent image which is electrostatically formed on a photoconductive drum by image light reflected from an original document. Among various apparatuses of the kind concerned, a dry process developing apparatus comprises a developing roller located to face the photoconductive drum between a charger and a transfer charger, a bladed toner supply roller positioned at the opposite side to the drum with respect to the developing roller in order to supply the toner to the developing roller, and a casing having the toner supply roller and developing roller thereinside and formed with an opening which faces the drum. Inside the casing, the toner is supplied from the toner supply roller onto the developing roller to form a magnet brush on the developing roller due to the attraction by a plurality of magnets installed in the developing roller. The magnet brush is brought into contact with the drum through the opening in accordance with the rotation of the developing roller.

A problem has existed in this type of developing apparatus in that the fine toner particles tend to fly apart through the gap between the drum and the upper end of the opening of the casing as well as through the gap between the drum and the lower casing end. The leaked toner particles smear an imaging system, transfer unit and other arrangements located around the developing device, thereby degrading the image quality to a critical degree unless frequent services are effected. Particularly, the casing lower end and drum are usually spaced a certain distance large enough to prevent a toner image carried on the drum from being damaged, allowing a substantial amount of toner particles to leak through the spacing. This part of the toner smears a lamp for image transfer which extends along the axis of the developing roller, resulting in a change in the intensity of illumination by the lamp. Any inadequate intensity level of illumination would effect the quality of reproduced images. Additionally, the toner dropping along the drum contaminates the transfer charger or a sheet guide and, as a result, renders the effect of the transfer charger uneven in the lengthwise direction while smearing sheets fed along the sheet guide.

The toner leakage described above becomes particularly prominent in the case of a two-component magnetic toner. When the toner is uncoupled from the carrier while being routed through various paths during development, fine particles thereof are made afloat.

Meanwhile, the developing apparatus of this type has a toner supply device which is located in an upper portion thereof. It is desirable that the toner fed downwardly from the toner supply device be caused to drop directly on the toner supply roller. However, the current tendency is to space the toner supply device as much as possible from the drum in the horizontal direction due to various layout limitations. For example, because the toner supply device which includes a toner container occupies a substantial space, it has to be located to avoid its interference with the imaging system.

Therefore, the toner from the container drops not on the toner supply roller but on the casing adjacent to the toner supply roller. As the time elapses, the toner dropping on the casing forms a heap. It is not until the heap of toner slides down that the toner is scooped into the gap between the blades of the toner supply roller and thereby fed to the developing roller. A certain period of time, therefore, expires before the toner is actually supplied by the toner supply roller to the developing roller. Should the development occur within this "transitional" period of time, the resulting image would be poor quality due to the short supply of toner.

SUMMARY OF THE INVENTION

It is therefore an object of the present invention to provide a dry process developing device which insures a constant quality of image reproduction without any contamination.

It is another object of the present invention to provide a dry process developing apparatus which prevents toner particles from flying off to the outside of the casing.

It is another object of the present invention to provide a dry process developing apparatus which in an apparatus for electrophotography protects various units therearound against contamination by the toner.

It is another object of the present invention to provide a dry process developing apparatus which shortens the transitional time in the toner supply while eliminating incomplete development.

It is another object of the present invention to provide a generally improved dry process developing apparatus.

In one aspect of the present invention, there is provided a dry process developing apparatus for processing an electrostatic latent image formed on a photoconductive element into a toner image. A housing is formed with an opening which faces the photoconductive element. A magnet brush forming member is positioned in the vicinity of the opening to form a magnet brush of a toner. A seal member seals a gap between the upper end of the opening of the housing and the photoconductive element, whereby leakage of the toner through the gap is prevented.

In another aspect of the present invention, there is provided a dry process developing apparatus for processing an electrostatic latent image formed on a photoconductive element into a toner image. A housing has thereinside a magnet brush forming member which forms a magnet brush of a toner. A toner supply member supplies a toner to the magnet brush forming member. A toner replenish device is formed with an opening for replenishing the toner to the toner supply member. An oscillator member applies oscillation to the toner in the toner replenish device which is guided to the toner supply member via the toner supply opening. A drive means drives the oscillator member.

The above and other objects, features and advantages of the present invention will become apparent from the following detailed description taken with the accompanying drawings.

DESCRIPTION OF THE PREFERRED EMBODIMENTS

While the dry process developing apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
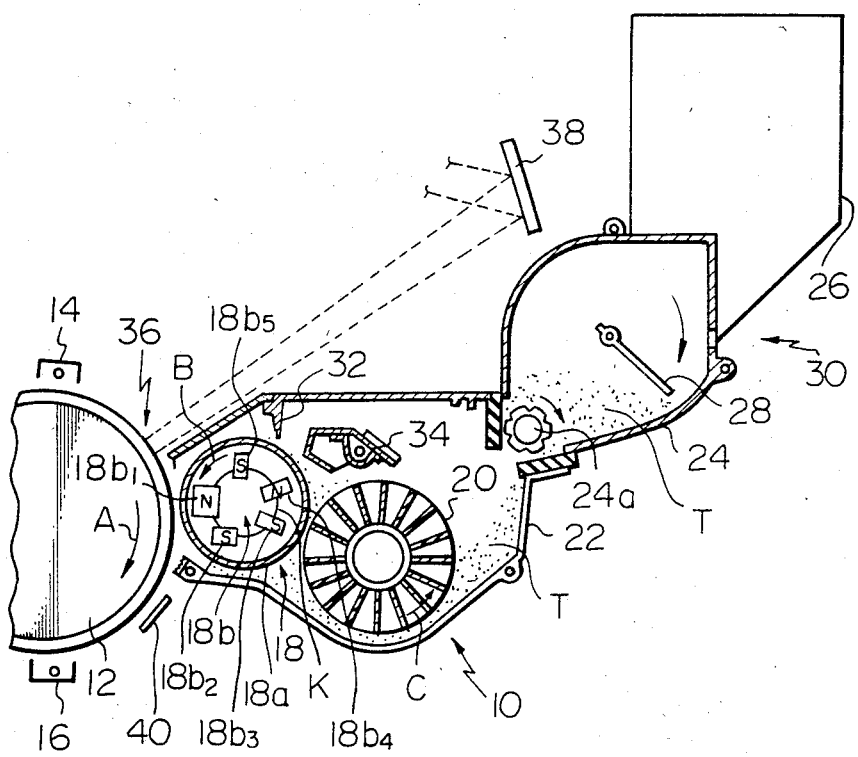
Fig. 1 PRIOR ART
FIG. 1 is a schematic view of a prior art dry process developing apparatus.

To facilitate understanding of the present invention, a brief reference will be made to a prior art apparatus for dry process development, depicted in FIG. 1. The apparatus generally designated by the reference numeral 10 is located to face a photoconductive drum 12 and between a charger 14 and a transfer charger 16, which are arranged around the drum 12. The drum 12 is rotatable as indicated by an arrow A during operation of the apparatus. A developing roller 18 comprises a cylindrical sleeve 18*a* and a group of magnets 18*b* fixed in position within the sleeve 18*a*. The sleeve 18*a* is rotatable relative to the magnet group 18*b* so that its part facing the drum 12 may move in the same direction as the drum 12, i.e., in the direction indicated by an arrow B. The magnet group 18*b* comprises a main pole $18b_1$ which contributes to the development in the developing region by raising a nap of a toner on the sleeve 18*a*, and four auxiliary poles $18b_2$–$18b_5$ at spaced locations along an imaginary circle K which passes through the main pole $18b_1$. The auxiliary poles $18b_2$–$18b_5$ are adapted to convey the toner on the sleeve 18*a*.

A toner supply roller 20 faces the developing roller 18 and comprises either a magnetic roller as the developing roller 18 or a roller having a number of radially extending blades as illustrated. The bladed roller will scoop the toner into the gaps between its blades and supply it to the developing roller 18 as it is rotated as indicated by an arrow C.

Both the developing roller 18 and toner supply roller 20 are installed in a housing 22 which is open at its portion which opposes the drum 12. The housing 22 is also open at its upper part located to the right and above the roller 20 and communicated thereat to a container 24 which stores a fresh supply of toner T thereinside. The toner T is fed from the container 24 toward the roller 20 in accordance with the rotation of a roller 24*a*. The toner T is replensished from a hopper 26 into the container 24 and constantly agitated therein by an agitator 28. The container 24, roller 24*a*, hopper 26 and agitator 28 constitute in combination a toner replenish device 30.

The toner T fed by the roller 20 onto the sleeve 18*a* forms a magnet brush under the attraction by the magnet group 18*b*. The magnet brush moves toward the drum 12 together with the sleeve 18*a* while the height of its nap is regulated by a blade 32. A separator 34 is positioned above the rollers 18 and 20 in order to control the flow of the toner within the housing 22.

An exposure station 36 is located between the developing apparatus 10 and the charger 14. Image light reflected by a document is passed through an imaging system 38 to the exposure station 36. A latent image thus formed electrostatically on the drum 12 is developed by the apparatus 10 into a toner image. The toner image is illuminated by a lamp 40 to have its adhesion to the drum 12 weakened to a level suitable for transfer and, then, transferred onto a sheet of paper while passing through the transfer charger 16.

The present invention is successful to preclude the leakage of the toner through the gaps between the drum and the upper and lower ends of the adjacent opening of the housing, which has been the drawback inherent in the prior art developing apparatus as previously discussed.

Figure 2:
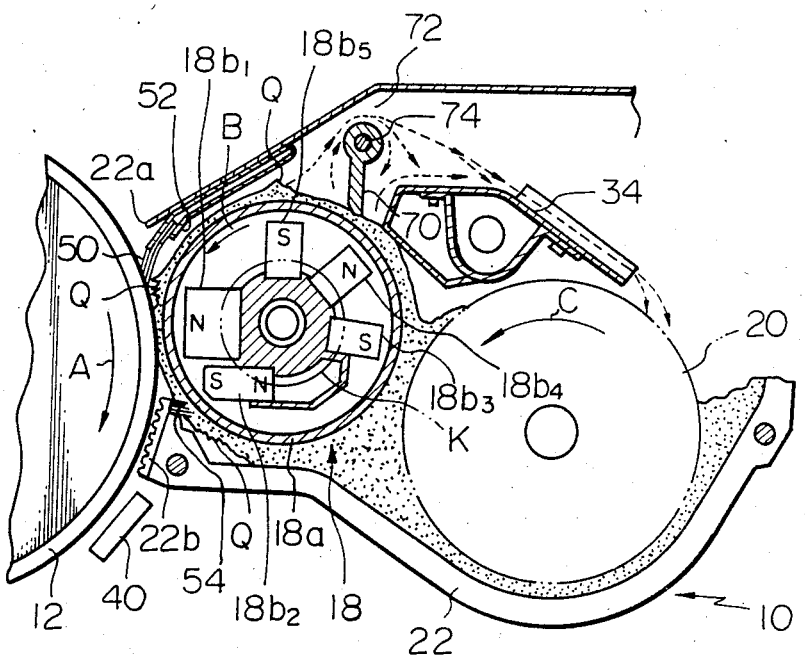
FIG. 2 is a schematic view of a dry process developing apparatus embodying the present invention.

Referring to FIG. 2, a dry process developing apparatus embodying the present invention is shown. In FIG. 2, the structural elements common to those shown in FIG. 1 are designated by like reference numerals. A characteristic feature of the illustrated embodiment is that a first seal member 50 is employed to prevent the toner from being scattered through the gap between the drum 12 and the upper end of the housing 22. The seal member 50 is firmly nipped by a bent plate member 52 which is rigidly mounted on the underside of an upper portion 22*a* of the housing 22. Thus, the gap between the housing upper end 22*a* and the drum 12 is closed by the seal member 50. It is a primary requisite that the seal member 50 be made of a material which is electrically insulating to be prevented from disturbing a latent image on the drum 12 and is hardly chargable even under frictional contact with the drum 12. Concerning the insulation, for example, a film or a brush is suitable which is made of insulating filaments of the kind which exhibits a resistance of $10^9\Omega$ or more when engaged with the drum 12 over the width of 300 mm, e.g. fluorine-contained resin. A desirable example is a brush made of Teflon. The filaments which form the brush should be soft and have a diameter within the range of about 50–200 microns. The effective design of such a brush may be such that the filaments are arranged to a density of about 20,000 /cm and allowed to flex over about 1 mm in contact with the drum and throughout the width of the drum while following the rotation of the drum.

Another characteristic feature of the apparatus of the present invention is that a second seal member 54 is located at a lower end 22*b* of the housing 22. The seal member 54 is secured at one end to the housing lower end 22*b* and extends along the rotating direction of the sleeve 18*a* such that the other end thereof faces the auxiliary pole $18b_2$ and contacts the sleeve 18*a* or the toner on the sleeve 18*a*. The seal member 54 extends in the axial direction of the sleeve 18*a*. Preferably, the seal member 54 comprises a brush having acrylic or like soft filaments which are about 7 mm in the length of their free portion and 20,000–30,000 per square inch in density.

The toner on the sleeve 18*a* is adhered thereto by the magnetic field developed by the main pole $18b_1$ and, in the developing region, the nap of the magnet brush is raised to stroke the latent image on the drum 12. The nap between the main pole $18b_1$ and the auxiliary pole $18b_2$ is laid down but becomes raised again as soon as it enters the zone where the magnetic field of the auxiliary pole $18b_2$ is strong. At this instant, the toner carried by the end of the nap tends to separate therefrom and the separated part of the toner falls down through the gap between the housing lower end 22*b* and the drum 12, bringing about the problem particular to the prior art apparatus. In accordance with the present invention, when the nap is raised as indicated by Q in FIG. 2 on the sleeve 18*a* adjacent to the auxiliary pole 18*b*$_2$, the second seal member 54 checks the toner at a position ahead of the raised nap Q with respect to the rotating direction of the sleeve 18*a*. Therefore, major part of the toner separated from the nap is captured by the seal member 54 and thereby prevented from flying apart to the outside of the casing 22.

The brush exemplifying the seal member 54 is kept in light contact with the toner having the nap laid down, so that the toner separated from or about to be separated from the nap is caught. Where the brush 54 is located very close to the auxiliary pole 18*b*$_2$ in contact with the sleeve 18*a*, it will capture the toner immediately before or after the separation due to the rise of the nap. On the other hand, where the brush 54 is positioned adjacent to the main pole 18*b*$_1$ in contact with the sleeve 18*a*, it will check the toner which is separated from the raised nap and flying toward the outside.

As the operation of the developing apparatus 10 is repeated, the toner caught by the brush 54 may be progressively accumulated thereon. This problem can be settled by suitably designing the filament density of the brush 54 and selecting a soft material for the filaments. The same may be further implemented by selecting a material for the brush which approximates to the toner in charge characteristics, because such a material will hardly allow electric attraction to develop between the toner and the brush. While a brush yielded a favorable result in experiments, it may be replaced by a soft film-like elastic member without effecting the sealing effect.

The toner cloud due to the raised nap, apart from the position of the sleeve 18*a* corresponding to the auxiliary pole 18*b*$_2$, occurs also in a position corresponding to the auxiliary pole 18*b*$_5$ or as a result of an impact of the toner T on the drum 12 at the inlet of the developing region. The seal member 50 located in this position as already mentioned catches the toner separated by the raised nap, thereby maintaining the apparatus 10 clean more efficiently.

Figure 3:
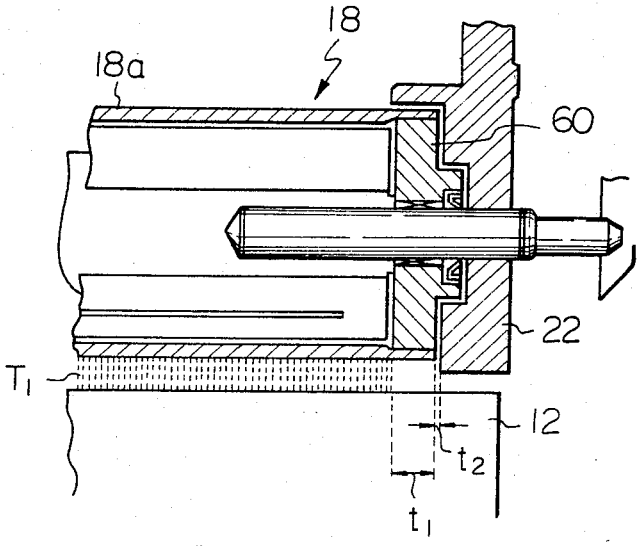
FIG. 3 is a fragmentary section of a developing roller shown in FIG. 2.

While effectively sealing the casing 22, the first and second seal members cause the air pressure inside the housing to rise due to the sealing. The elevation of the internal pressure of the housing 22 might allow the toner to leak through the gap between the drum 12 and the housing lower end 22*b*. Because the toner image carried on the drum 12 has to be protected against damage, it is impossible to dispose a strict sealing means between the drum 12 and the housing lower end 22*b*; a simple member of urethane rubber having an undulated surface is located in the vicinity of the drum 12. Still, the toner forms a magnet brush $T_1$ between the drum 12 and the sleeve 18*a* in the intermediate between the opposite ends of the drum 12 as illustrated in FIG. 3. The magnet brush $T_1$ functions to seal the housing lower end 22*b* against the leakage of the toner therethrough.

The toner leakage is also liable to occur at axially opposite ends of the developing roller 18 through gaps $t_1$ and $t_2$ shown in FIG. 3. The gap $t_1$ corresponds to a flange 60 which is rotatable integrally with the sleeve 18*a* but lacks a magnet and, therefore, magnetic attraction. The toner, therefore, does not form any nap and part of the toner let fall through the gap $t_1$ moves along the surface of the drum 12 to drop on part of the lamp 40 via the gap between the housing 22 and the drum 12, thereby smearing opposite end portions of the lamp 40. This makes the illumination intensity distribution of the lamp uneven along the length thereof and, therefore, results in an uneven transfer of the toner image onto a sheet. Additionally, the leaked toner smears the transfer charger 16 as well as a sheet guide (not shown), so that the effect of the transfer charger 16 becomes uneven along the length thereof and sheets become smeared. The gap $t_2$, on the other hand, is defined between the axial end of the flange 60 and the adjacent end of the housing 22. The toner dropping through this gap $t_2$ is as undesirable as the toner dropping through the gap $t_1$.

The toner leakage through the gaps $t_1$ and $t_2$ results from the fact that the pressure inside the hermetic space defined by the housing 22, developing roller 18, drum 12, seal members 50 and 54 and the like is elevated during the course of repeated rotation of the drum 12 and roller 18, blowing air out through the gaps $t_1$ and $t_2$ which may be regarded as a single outlet of the hermetic space.

Another characteristic feature of the illustrated embodiment is that, besides the seal members 50 and 54, a flat blade 70 is mounted integrally to the side walls of the casing 22 through a shaft 74 which extends throughout a base portion of the blade 70. The base portion of the blade 70 is spaced a predetermined distance from the top of the housing 22, so that a toner recirculation path 72 is defined at the back of the blade 70. The recirculation path 72 assists the gaps $t_1$ and $t_2$ as a second opening of the hermetic space concerned, which lowers the internal pressure of the hermetic space and thereby checks the toner which tends to leak through the gaps $t_1$ and $t_2$. The recirculation path 72 allows the toner to flow as indicated by phantom lines in FIG. 2. As shown, air entraining the toner flows through the path 72 to the outside and this, coupled with the pressure loss in the path 72 which is predetermined to be smaller than that in the gaps $t_1$ and $t_2$, eliminates the toner leakage through the gaps $t_1$ and $t_2$.

Figure 4:
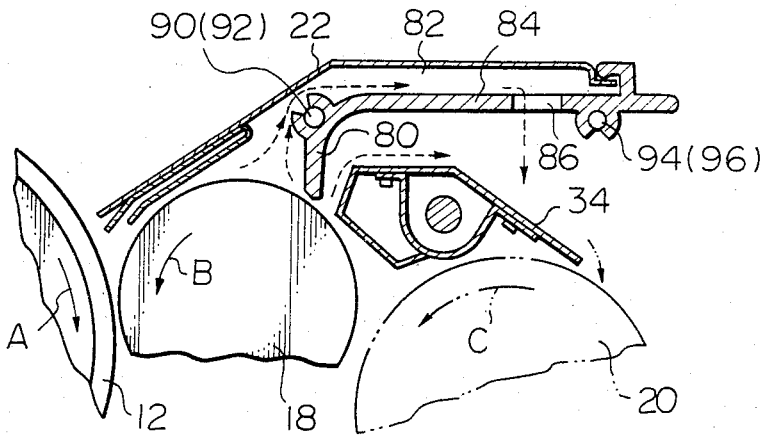
FIG. 4 is a schematic view of a second embodiment of the present invention.
Figure 5:
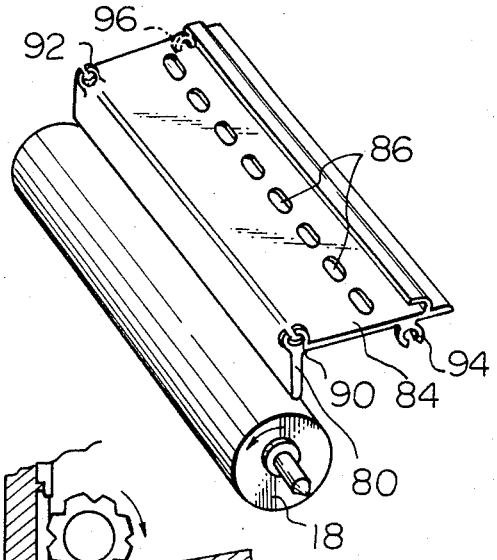
FIG. 5 is a perspective view of a blade included in the arrangement of FIG. 4.

Referring to FIGS. 4 and 5, another embodiment of the present invention is shown which employs a generally L-shaped blade 80 for defining a modified toner recirculation path 82. As shown, the blade 80 has an extension 84 which extends in parallel with the top wall of the housing 22 as far as a position above the toner supply roller 20. The extension 84 is formed with openings 86 therethrough. With this construction, the recirculation path 82 comprises the space defined between the casing 22 and the blade extension 84 and the opening 86 of the blade extension 84. The openings 86 may be dimensioned and shaped as desired insofar as its position is optimum for the agitation of the recirculated toner, which is immediately above the separator 34 in this embodiment.

Dropping the recirculated toner in the position remote from the roller 18 is also advantageous in the following respects. If the recirculated toner is dropped in the vicinity of the roller 18, it will be reused for development under the fatigued condition and by a substantial proportion relative to fresh one. Thus, the toner dropped at a position remote from the roller 18 will be mixed with a fresh supply of toner to form a composition which is desirable for development. Meanwhile, if the drop point of the recirculated toner neighbors the roller 18, a large amount of toner will be dropped by gravity to possibly leak through the gaps $t_1$ and/or $t_2$. This possibility is eliminated by the construction shown in FIG. 4. The dimensions, shape, pitch and others of the openings 86 may be varied to control the distribution of the toner within the casing 22 as desired.

Furthermore, the blade 80 is supported at as many as four positions 90, 92, 94 and 96 at the front and rear ends thereof. This implements the means indispensable for firmly and accurately retaining a blade of the kind concerned which regulates the thickness of a magnet brush by stroking the brush which is adhered to a roller under strong magnetic attraction.

Still another embodiment of the present invention will be described with reference to FIGS. 6 and 7. As shown, the apparatus includes an oscillator plate 100 made of a material which is resilient and sparingly gathers rust, e.g. phosphor bronze or stainless steel. The oscillator plate 100 has a base end 100*a* which is rigidly nipped between the upper end of the housing 22 and the lower end of the container 24. The base end 100*a* connects to a flat extension 100*b* which is bent generally downwardly toward the toner supply roller 20 across the toner drop path. The lowermost or free edge of the extension 100*b* is positioned quite close to the periphery of the roller 20 as illustrated. Legs 100*c* and 100*d* extend from the opposite ends of the extension 100*b* to have the roller 20 therebetween. Pins 102*a* and 102*b* (only the pin 102*a* is visible) are studded on the opposite side walls of the roller 20 so that they may interfere with the oscillator legs 100*c* and 100*d*, respectively.

Figure 6:
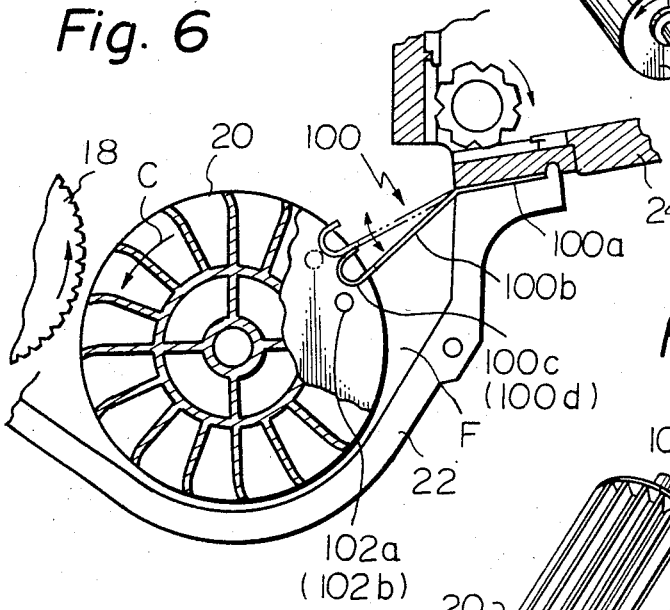
FIG. 6 is a fragmentary view of another embodiment of the present invention.
Figure 7:
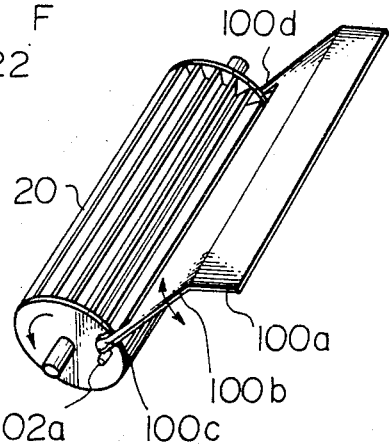
FIG. 7 is a perspective view of the construction shown in FIG. 6.

As the roller 20 is rotated in the direction C in FIG. 6, the pins 102*a* and 102*b* rotating with the roller 20 urge their associated legs 100*c* and 100*d* upwardly. The engagement of the pins 102*a* and 102*b* with the oscillator legs 100*c* and 100*d* is automatically released in due course so that the oscillator 100 springs back to the original position. Such successive actions of the oscillator 100, particularly the snap to the original position, causes the toner deposited on the extension 100*b* to hop into the gap between the blades of the roller 20. As a result, the dropping toner is not accumulated in the space F but caught by the oscillator extension 100*b* and then forcibly fed to the toner supply roller 20 by the oscillation. This has the effect of remarkably shortening the transitional time period in the supply of toner to the developing roller 18. While the means for oscillating the oscillator 100 has been shown and described as comprising the legs 100*c* and 100*d* and the pins 102*a* and 102*b*, it may be replaced by a solenoid or the like which causes the oscillator into oscillation at a predetermined frequency. If desired, two or more pins may be studded on each side of the roller 20 at circumferentially spaced locations in due consideration of the expected amount of the dropping toner; the larger the number of the pins, the larger the frequency of oscillation of the oscillator 100 becomes. It will be noted that each oscillator leg 100*c* or 100*d* may be curved as illustrated in FIG. 6 in order to promote smooth movement of the pin 102*a* or 102*b* into and out of contact with the leg 100*c* or 100*d*.

In accordance with the present invention, there is eliminated the design restriction that the toner supply device 30 and toner supply opening should be located immediately above the toner supply roller, so that the toner can be supplied within a shorter period of time than in the prior art apparatus.

Various modifications will become possible for those skilled in the art after receiving the teachings of the present disclosure without departing from the scope thereof.

What is claimed is:

1. A dry process developing apparatus for processing an electrostatic latent image formed on a rotary photoconductive element into a toner image, comprising:

a housing formed with an opening which faces the photoconductive element;

a rotary magnet brush forming member positioned in the vicinity of said opening to form a magnet brush of a toner;

an upper seal member for sealing a gap between the upper end of the opening of the housing and the photoconductive element;

whereby leakage of the toner through said gap is prevented; and a second seal member for sealing a gap between the lower end of the opening of the housing and the magnet brush forming member for thereby preventing the toner from leaking through the gap;

the second seal member being secured to the lower end of the opening of the housing at one end thereof and extending along the moving direction of the magnet brush forming member at the other end thereof into contact with the magnet brush formed on the magnet brush forming member.

2. An apparatus as claimed in claim 1, in which the upper seal member is fixedly mounted at one end thereof to the upper end of the opening of the housing while being engaged with the photoconductive element at the other end thereof.

3. An apparatus as claimed in claim 2, in which the upper seal member comprises a brush made of insulating filaments.

4. An apparatus as claimed in claim 3, in which the insulating filaments exhibit a resistance which is not less than $10^9\Omega$ when engaged with the photoconductive element over a width of 300 mm.

5. An apparatus as claimed in claim 3, in which the insulating filaments are made of fluorine-contained resin.

6. An apparatus as claimed in claim 3, in which the insulating filaments are made of Teflon.

7. An apparatus as claimed in claim 3, in which the filaments of the brush have a diameter within the range of 50–200 microns and are arranged to a density of 20,000/cm, the brush being flexible over a dimension of 1 mm relative to the photoconductive element and throughout the length of the photoconductive element and being located at such an angle that a portion thereof engaged with the photoconductive element follows the rotation of the photoconductive element in direction.

8. An apparatus as claimed in claim 2, in which the upper seal member comprises a film-like elastic member constituted by insulating filaments.

9. An apparatus as claimed in claim 1, in which adjacent surfaces of the photoconductive element and the magnet brush forming member move in a same direction.

10. An apparatus as claimed in claim 1, in which the second seal member comprises a brush which is constituted by soft filaments.

11. An apparatus as claimed in claim 10, in which the brush comprises acrylic filaments.

12. An appratus as claimed in claim 10, in which the filaments of the brush have a diameter of 100 microns ad are arranged to a density of 20,000–30,000 per square inch.

13. An apparatus as claimed in claim 1, in which the second seal member comprises a film-like elastic member.

14. A dry process developing apparatus for processing an electrostatic latent image formed on a photoconductive element into a toner image, comprising:

a housing formed with an opening which faces the photoconductive element;

a magnet brush forming member positioned in the vicinity of said opening to form a magnet brush of a toner;

an upper seal member for sealing a gap between the upper end of the opening of the housing and the photoconductive element;

whereby leakage of the toner through said gap is prevented;

a second seal member for sealing a gap between the lower end of the opening of the housing and the magnet brush forming member for thereby preventing the toner from leaking through said gap;

a blade member located above the magnet brush forming means inside the housing, said blade member being spaced a predetermined distance from the magnet brush forming means at one end thereof to regulate the nap of the magnet brush to a predetermined height; and a toner recirculation path for causing air and entrained toner to recirculate from a space defined around the magnet brush forming member by the upper and second seal members and the blade member to another space defined inside the housing;

the recirculation path being defined by a passageway between the other end of the blade member secured to the housing and an upper wall of the housing.

15. An apparatus as claimed in claim 14, further comprising a toner supply member disposed in the housing to supply the toner to the magnet brush forming member, the blade member having an extension directed toward the toner supply member.

16. An apparatus as claimed in claim 15, in which the extension of the blade member is formed with openings immediately above the toner supply member and provided with a portion to be fixed to the housing.

17. A dry process developing apparatus for processing an electrostatic latent image formed on a photoconductive element into a toner image, comprising:

a housing;

a magnet brush forming member disposed in said housing to form a magnet brush of a toner;

a toner supply member for supplying a toner to the magnet brush forming member;

a toner replenish device formed with an opening for replenishing the toner to the toner supply member;

an oscillator member for applying oscillation to the toner in the toner replenish device which is guided to the toner supply member via the toner supply opening; and means connecting the toner supply member to the oscillator member such that movement of the toner supply member causes oscillation of the oscillator member.

18. An apparatus as claimed in claim 17, in which the oscillator member is disposed below the toner supply opening.

19. A dry process developing apparatus for processing an electrostatic latent image formed on a photoconductive element into a toner image, comprising:

a housing;

a magnet brush forming member disposed in said housing to form a magnet brush of a toner;

a toner supply member for supplying a toner to the magnet brush forming member;

a toner replenish device formed with an opening for replenishing the toner to the toner supply member;

an oscillator member for applying oscillation to the toner in the toner replenish device which is guided to the toner supply member via the toner supply opening; and a drive means for driving said oscillator member;

the oscillator member comprising a base end portion fixedly connected to the lower end of the toner supply opening of the toner replenish device, a flat portion extending from said base end portion toward the toner supply member, and legs individually extending from the flat portion to neighbor the toner supply member.

20. An apparatus as claimed in claim 19, in which the drive means comprises an oscillation applying member which is engagable with the legs of the oscillator member at a predetermined interval to apply oscillation to the oscillator member.

21. An apparatus as claimed in claim 20, in which the drive means comprises a solenoid operated device.

* * * * *